US005852390A

United States Patent [19]

Yoshimura

[11] Patent Number: 5,852,390

[45] Date of Patent: Dec. 22, 1998

[54] CIRCULARLY POLARIZED WAVE-LINEARLY POLARIZED WAVE TRANSDUCER

[75] Inventor: Yoshikazu Yoshimura, Takatsuri, Japan

[73] Assignee: Matsushita Electric Industrial Co., Ltd., Osaka, Japan

[21] Appl. No.: 748,370

[22] Filed: Nov. 13, 1996

[30] Foreign Application Priority Data

Nov. 13, 1995 [JP] Japan ..... 7-293941

[51] Int. Cl.[6] ..... H01P 1/17

[52] U.S. Cl. ..... 333/21 A; 333/242

[58] Field of Search ..... 333/21 R, 21 A, 333/242, 251

[56] References Cited

U.S. PATENT DOCUMENTS

| | | | |
|---|---|---|---|
| H1492 | 10/1995 | Park et al. | 333/21 R |
| 2,741,744 | 4/1956 | Driscoll | 333/21 A |

FOREIGN PATENT DOCUMENTS

| | | | |
|---|---|---|---|
| 0 022 401 | 1/1981 | European Pat. Off. . | |
| 36 13474 | 10/1987 | Germany . | |
| 59-108302 | 7/1984 | Japan . | |
| 1-97001 | 4/1989 | Japan . | |
| 3-131101 | 6/1991 | Japan | 333/21 A |

OTHER PUBLICATIONS

B. Ladanyi–Turoczy, "Design of a Superelliptic Waveguide Polarizer", *16th European Microwave Conference*, pp. 441–446 (Sep. 8–12, 1986).

European Search Report dated Jan. 28, 1997.

*Primary Examiner*—Paul Gensler

*Attorney, Agent, or Firm*—Ratner & Prestia

[57] ABSTRACT

A circularly polarized wave-linearly polarized wave transducer using a waveguide characterized by expanding the inner wall of the section vertical to the tube axis of the waveguide in a taper form having a gradient in the axial direction of the tube. The taper gradient in the axial direction of the tube is different at plural parts in the circumferential direction of the inner wall, thereby producing a difference in the propagation constant of two modes orthogonal at a microwave frequency. The taper gradient and overall length of the waveguide are determined so that the phase difference of the two modes is $\pi/4$ at each end of the waveguide. The circularly polarized wave-linearly polarized wave transducer can be realized in a simple construction in which the core of a die in the die-casting process can be drawn out in only one direction.

11 Claims, 2 Drawing Sheets

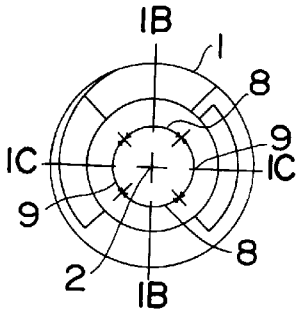
FIG. IA
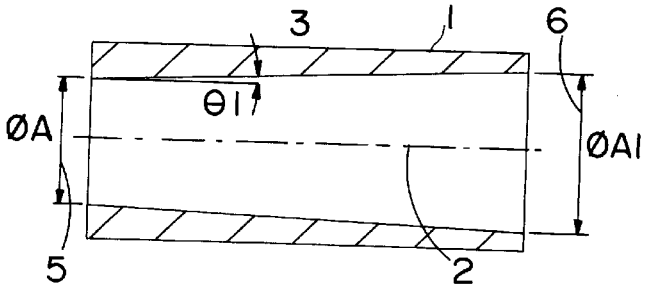
FIG. IB
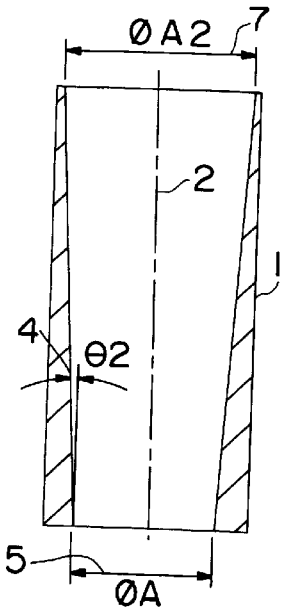
FIG. IC

CIRCULARLY POLARIZED WAVE-LINEARLY POLARIZED WAVE TRANSDUCER

BACKGROUND OF THE INVENTION

The present invention relates to a circularly polarized wave-linearly polarized wave transducer using a waveguide operated at microwave frequency.

Hitherto, as the circularly polarized wave-linearly polarized wave transducer using a waveguide operated at microwave frequency, as shown in a side view and a front sectional view in FIGS. 2(*a*), (*b*), a dielectric plate 12 was inserted in a tube of a circular waveguide 11 for transmitting TE11 mode at the operating frequency; as shown in a side view and a front sectional view in FIG. 3(*a*), (*b*), a trapezoidal ridge metal piece 14 was placed in the tube axial direction of a circular waveguide on the inner wall of a circular waveguide 13 for transmitting TE11 mode at the operating frequency; or as shown in a side view and a front sectional view in FIGS. 4(*a*), (*b*), the sectional shape of a circular waveguide 15 for transmitting TE11 mode at the operating frequency was deformed in steps by a metal piece 16.

However, the circularly polarized wave-linearly polarized wave transducers of the prior art individually had the following problems.

In FIGS. 2(*a*) and 2(*b*) the dielectric 12 was needed, and it also required means for holding the dielectric 12 within the tube of the circular waveguide 11 in order to inscribe the dielectric 12 in the inner wall of the circular waveguide 11, while a strict relative precision was also demanded.

In FIGS. 3(*a*) and 3(*b*) although the dielectric was not necessary, when manufacturing the circular waveguide 13 integrating the ridge metal piece 14 by die-casing process, it was required to divide the slide core of the die into two sections due to shape restriction of the ridge metal piece 14 to draw out from both sides in the tube axial direction of the circular waveguide 13.

In FIGS. 4(*a*) and 4(*b*) since the sectional shape is changed largely in steps by the metal piece 16, discontinuity of impedance was caused, and sufficient performance could not be obtained.

SUMMARY OF THE INVENTION

It is hence an object of the invention to present a circularly polarized wave-linearly polarized wave transducer using a circular waveguide, without using dielectric, capable of drawing out a slide core of a die from one side only when manufacturing by die-casting process, and not causing discontinuity of impedance.

The invention presents a circularly polarized wave-linearly polarized wave transducer using a circular waveguide characterized by expanding the inner wall of the section vertical to the tube axis of the circular waveguide in a taper form having a gradient in the tube axial direction, setting the taper gradient in the tube axial direction differently at plural parts in the circumferential direction of the inner wall, thereby producing a difference in the propagation constant of two modes orthogonal at the microwave frequency being used, and determining the taper gradient and overall length of the circular waveguide so that the phase difference of the two modes may be $\pi/4$ at both ends of the circular waveguide.

According to one aspect of the present invention, a circularly polarized wave-linearly polarized wave transducer characterized by expanding the inner wall at a section vertical to the tube axis of the circular waveguide in a taper form having a gradient to the tube axial direction, feeding a circularly polarized wave from one end of the circular waveguide having the taper gradient in the tube axial direction of the diameter of the inner wall different at plural parts in the circumferential direction of the inner wall, and delivering a linearly polarized wave from other end, whereby (1) the material cost and assembling and manufacturing cost are saved because dielectric is not used, and thereby the yield is enhanced, (2) according to the die-cast process capable of drawing out the slide core of the die from one side only of the tube axis of the circular waveguide, the die manufacturing and process manufacturing control process are saved, and the yield is enhanced and the cost is also curtailed, and (3) the diameter of the inner wall at a section vertical to the tube axis of the circular waveguide is expanded in a taper form having a gradient in the tube axial direction, and hence the impedance is not discontinuous, performance is enhanced, and also circularly polarized wave-linearly polarized wave transformation by circular waveguide is achieved.

According to another aspect of the present invention, a circularly polarized wave-linearly polarized wave transducer characterized by feeding a circularly polarized wave from one end and delivering a linearly polarized wave from other end of a circular waveguide formed by disposing a first pair of a confronting pair portions of the inner wall on a section vertical to the tube axis of the circular waveguide divided into four sections equally in the circumferential direction of the first circular waveguide expanding with a first taper gradient in the tube axial direction, and a second pair of second confronting pair portions divided into four sections equally in the circumferential direction of a second circular waveguide expanding with a second taper gradient different from the first taper gradient, alternately in the individual confronting pair portions while keeping same the taper direction, whereby (1) the material cost and assembling and manufacturing cost are saved because dielectric is not used, and thereby the yield is enhanced, (2) according to the die-cast process capable of drawing out the slide core of the die from one side only of the tube axis of the circular waveguide, the die manufacturing and process manufacturing control process are saved, and the yield is enhanced and the cost is also curtailed, and (3) the diameter of the section vertical to the tube axis of the circular waveguide is expanded in a taper form having a gradient in the tube axial direction, and hence the impedance is not discontinuous, performance is enhanced, and also circularly polarized wave-linearly polarized wave transformation by waveguide is achieved.

According to another aspect of the present invention, a circularly polarized wave-linearly polarized wave transducer characterized by the constitution for transforming from circularly polarized wave to linearly polarized wave most efficiently when a phase difference of $\pi/4$ is produced between a first mode for propagating a wave in the first circular waveguide and a second mode for propagating a wave in the second circular waveguide.

According to another aspect of the present invention, a circularly polarized wave-linearly polarized wave transducer composed of a waveguide having a circular inner wall section at one end of the waveguide the other end of which inner wall section is a shape divided by a circle of an inner diameter different in the right angle direction, in which the circularly polarized wave is input to the waveguide at the end with the circular inner wall section, and the circular section of the section of output portion of linearly polarized wave having a different inner diameter in the right angle direction is divided and arranged in the circumferential direction, and thereby an efficient transformation of circularly polarized wave and linearly polarized wave is realized. In particular, the section of the output portion is replaced by an ellipse, which possesses approximately similar effects.

The circularly polarized wave-linearly polarized wave transducer of the invention brings about the following effects.

The material cost and assembling and manufacturing cost are saved because dielectric is not used, and thereby the yield is enhanced.

According to the die-cast process capable of drawing out the slide core of the die from one side only of the tube axis of the circular waveguide, the die manufacturing and process manufacturing control process are saved, and the yield is enhanced and the cost is also curtailed.

The diameter of the section vertical to the tube axis of the waveguide is expanded in a taper gradient in the tube axial direction, and hence the impedance is not discontinuous, performance is enhanced.

BRIEF DESCRIPTION OF THE DRAWINGS

FIG. 1(*a*) is a front view of a circularly polarized wave-linearly polarized wave transducer in an embodiment of the invention;

FIG. 1(*b*) is a side sectional view along cut-off line 1B—1B in FIG. 1(*a*);

FIG. 1(*c*) is a side sectional view along cut-off line 1C—1C in FIG. 1(*a*);

FIG. 2(*b*) is a front view of FIG. 2(*a*);

FIG. 3(*b*) is a front view of FIG. 3(*a*);

FIG. 4(*b*) is a front view of FIG. 4(*a*).

DESCRIPTION OF THE PREFERRED EMBODIMENT

Figure 2A:
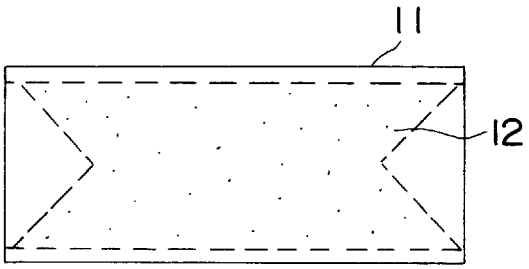
FIG. 2A PRIOR ART
FIG. 2(*a*) is a side view of a circularly polarized wave-linearly polarized wave transducer in a conventional embodiment.
Figure 2B:
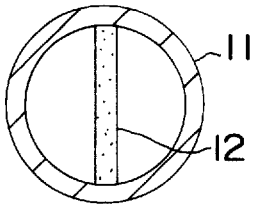
FIG. 2B PRIOR ART
Figure 3A:
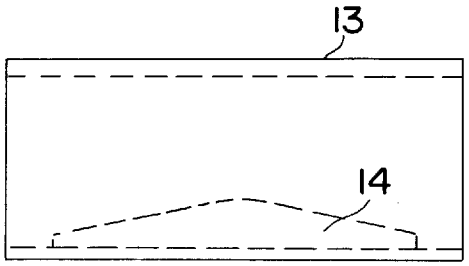
FIG. 3A PRIOR ART
FIG. 3(*a*) is a side view of a circularly polarized wave-linearly polarized wave transducer in other conventional embodiment.
Figure 3B:
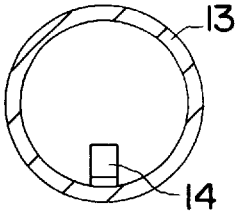
FIG. 3B PRIOR ART
Figure 4A:
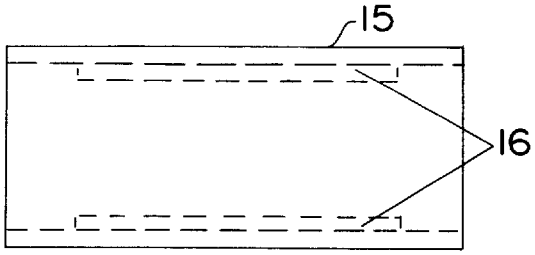
FIG. 4A PRIOR ART
FIG. 4(*a*) is a side view of a circularly polarized wave-linearly polarized wave transducer in a different conventional embodiment.
Figure 4C:
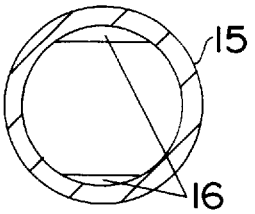
FIG. 4C PRIOR ART

FIG. 1(*a*), FIG. 1(*b*), and FIG. 1(*c*) refer to an embodiment of the invention, respectively showing a front view of a circular waveguide manufactured by die-casting process from aluminum or the like, a side sectional view along cut-off line 1B—1B in FIG. 1 (*a*), and a side sectional view along cut-off line 1C—1C in FIG. 1(*a*). FIG. 1(*a*) is a front view as seen from the direction of a tube axis 2 of a circular waveguide 1, or, in other words, a front view as seen from the direction of drawing out the slide core of the die in the die-casting process.

In FIGS. 1(*a*), (*b*), (*c*), the circular waveguide 1 has its inner wall at a section vertical to the tube axis 2 of the circular waveguide 1 expanded in a taper having a gradient in the tube axial direction, and the taper gradient in the tube axial direction is different in plural portions in the circumferential direction of the inner wall.

One end of the circular waveguide 1 is a circle of which diameter 5 of the inner wall is ϕ A. The diameter of the inner wall (corresponding to curvature) of the circular waveguide 1 is expanded in a taper gradient in the direction of tube axis 2, that is, in the tube axis direction of the circular waveguide 1. This taper gradient is a first gradient 3 (θ 1) in the side sectional view in FIG. 1(*b*), and is a second gradient 4 (θ 2) different from gradient 3 in the side sectional view in FIG. 1(*c*). Herein, θ 1 is smaller than θ 2.

Therefore, at the other end of the circular waveguide 1, the diameter of inner wall (corresponding to curvature) of the circular waveguide 1 in the side sectional view in FIG. 1(*b*) and side sectional view in FIG. 1(*c*) is respectively first diameter 6 (ϕ A1) and second diameter 7 (ϕ A2), and the first diameter A1 is smaller than the second diameter A2.

The taper shape shown in side sectional view in FIG. 1(*b*) and side sectional view in FIG. 1(*c*) is formed in the arc portion of a corresponding quarter of a circle in the circumferential direction of the circular waveguide 1. That is, in the front view in FIG. 1(*a*), the portion forming the taper with gradient 3 is formed at a position indicated by angle 8, and the portion forming the taper with gradient 4 is formed at a position indicated by angle 9. Both angle 8 and angle 9 are 90 degrees.

In the circular TE11 mode in which the maximum electric field vector is orthogonal to start point and end point of a confronting arc within angle 8 in the diagram, that is, in the circular TE11 mode in which the maximum electric field vector coincides with line segment P–P' in the diagram (hereinafter called mode 1), the circular waveguide 1 may be equivalently regarded as a tapered elliptical waveguide.

Similarly, in the circular TE11 mode in which the maximum electric field vector is orthogonal to start point and end point of a confronting arc within angle 9 in the diagram, that is, in the circular TE11 mode in which the maximum electric field vector coincides with line segment Q–Q' in the diagram (hereinafter called mode 2), the circular waveguide 1 may be equivalently regarded as a tapered elliptical waveguide. That is, in the circular waveguide 1, the elliptical waveguide corresponding to mode 1 and the elliptical waveguide corresponding to mode 2 are disposed at positions indicated by angle 8 and angle 9, respectively.

The taper gradient 3 (θ 1) of the elliptical waveguide corresponding to mode 1 is smaller than the taper gradient 4 (θ 2) of the elliptical waveguide corresponding to mode 2, and therefore the wavelength within the tube (λ g) in mode 2 is longer than the wavelength within the tube in mode 1 (the propagation constant refers to 2π/λ g).

The gradient 3 (θ 1), gradient 4 (θ 2), and overall length (L) of circular waveguide can be experimentally determined in the relation of $$(2\pi/\lambda g)L=\pi/4$$

at the operating frequency, and a phase difference of π/4 occurs between the two modes.

Therefore, the circularly polarized wave entering from one end in the tube axial direction of the circular waveguide 1 propagates in the circular waveguide 1 as two circular TE11 modes (mode 1 and mode 2) with a phase difference of π/4, and at the other end these two modes 1 and 2 are in phase and transformed into a linearly polarized wave.

Incidentally, the taper of the inner wall of the circular waveguide 1 is not limited to linear taper, but it may be also a curved taper or a taper including a discontinuous step portion so far as discontinuity of impedance may not be caused.

The phase difference π/4 may be (N+¼)π (N is an integer).

In the embodiment, the diameter of the inner wall (corresponding to curvature) of the circular waveguide 1 in FIG. 1(*a*) is a combination of two circles of first diameter of a circle coinciding with line segment P–P', and second diameter of a circle coinciding with line segment Q–Q', but, of course, same effects are obtained by the inner wall section of elliptical shape having first and second diameter approximately.

I claim:

1. A circularly polarized wave-linearly polarized wave transducer comprising:

a circular waveguide having an inner wall, an axial direction and a circumferential direction perpendicular to the axial direction, said circular waveguide having a plurality of curved portions, each portion having a different position along the circumferential direction of the circular waveguide, the diameter of the inner wall in a first one of said plurality of curved portions being tapered with a first constant gradient in the axial direction, the diameter of the inner wall in a second one of said plurality of curved portions being tapered with a second constant gradient in the axial direction, said second constant gradient being different from said first constant gradient, wherein a section of the inner wall of at least one end of the waveguide has an elliptical shape.

2. A circularly polarized wave-linearly polarized wave transducer of claim 1, wherein i) a diameter of the inner wall of the first one of the plurality of curved portions of the circular waveguide is formed by a first pair of curved portions on opposite sides of the circular waveguide, each having the first constant gradient in the axial direction, and ii) a diameter of the second one of the plurality of curved portions of the circular waveguide is formed by a second pair of curved portions on opposite sides of the circular waveguide, each having the second constant gradient in the axial direction, wherein each one of the first pair of curved portions alternates with a respective one of the second pair of curved portions.

3. A circularly polarized wave-linearly polarized wave transducer of claim 1, wherein a phase difference of $\pi/4$ is generated between i) a first mode propagating in said first one of said plurality of portions of the circular waveguide and ii) a second mode propagating in said second one of said plurality of portions of the circular waveguide.

4. A circularly polarized wave-linearly polarized wave transducer of claim 1, further comprising:

a first end, and a second end, wherein said first constant gradient and said second constant gradient extend from the first end to the second end and along the inner wall of the circular waveguide, and a circularly polarized wave enters from the first end of the circular waveguide, and a linearly polarized wave is generated and output at the second end of the circular waveguide.

5. A circularly polarized wave-linearly polarized wave transducer comprising:

a waveguide having a) a first end with an inner wall section having a first diameter, and b) a second end with an inner wall section in a shape of a circle and having a first partial circular portion with a second diameter in combination with a second partial circular portion with a third diameter i) different from the second diameter and ii) orthogonal to the second diameter, and c) a linear taper extending along the inner wall from the first end of the waveguide to the second end of the waveguide, wherein the inner wall section of the second end of the waveguide has an elliptical shape.

6. A wave transducer for use with a circularly polarized wave comprising:

a waveguide having a first end and a second end opposite the first end and an axial direction, and an inner wall tapered in the axial direction, including a plurality of curved axial inner wall portions extending from the first end to the second end of the waveguide, adjacent ones of said plurality of curved axial inner wall portions having different linear tapers in the axial direction inside the waveguide, wherein an inner wall section of the second end of the waveguide has an elliptical shape.

7. The wave transducer of claim 6, wherein the wave guide is formed from aluminum.

8. The wave transducer of claim 6, wherein the first end includes a first portion of the inner wall, having a first diameter and a first constant gradient in the axial direction of the waveguide, and a second portion of the inner wall, having the first diameter and a second constant gradient different from the first constant gradient in the axial direction of the waveguide, the second end includes a second diameter in the first portion of the inner wall, and a third diameter in the second portion of the inner wall, the first portion having the first constant gradient extends from the first end of the waveguide to the second end of the wave guide and the diameter of the waveguide in the first portion varies between the first diameter and the second diameter, and the second portion having the second constant gradient extends from the first end of the waveguide to the second end of the wave guide and the diameter of the waveguide in the second portion varies between the first diameter and the third diameter.

9. The wave transducer of claim 8, wherein the first constant gradient matches a first propagation mode of the wave transducer, and the second constant gradient matches a second propagation mode of the wave transducer.

10. A wave transducer for use with a circularly polarized wave comprising:

a waveguide having a first end and a second end opposite the first end and an axial direction, and an inner wall tapered in the axial direction, including a plurality of curved axial inner wall portions extending from the first end to the second end of the waveguide, adjacent ones of said plurality of curved axial inner wall portions having different linear tapers in the axial direction inside the waveguide, the first end includes a first diameter in a first portion of the inner wall, the first diameter having a first constant gradient in the axial direction of the waveguide, and a second diameter in a second portion of the inner wall, the second diameter having a second constant gradient different from the first constant gradient in the axial direction of the waveguide, the second end includes a third diameter in the first portion of the inner wall, and a fourth diameter in the second portion of the inner wall, the first portion having the first constant gradient extends from the first end of the waveguide to the second end of the wave guide and the diameter of the waveguide in the first portion varies between the first diameter and the third diameter, and the second portion having the second constant gradient extends from the first end of the waveguide to the second end of the wave guide and the diameter of the waveguide in the second portion varies between the second diameter and the fourth diameter, wherein the first portion of the inner wall of the wave guide includes two curved one-quarter portions of the inner wall, the second portion of the inner wall of the wave guide includes the remaining two curved one-quarter portions of the inner wall, the inner wall at the first end of the waveguide alternates between the first diameter and the second diameter, and the inner wall at the second end of the waveguide alternates between the third diameter and the fourth diameter.

11. A circularly polarized wave-linearly polarized wave transducer comprising:

a circular waveguide having an axial direction and a curved inner wall defining a plurality of axial sections perpendicular to the axis of the circular waveguide, each axial section of said plurality of axial sections having a respective constant gradient in the axial direction, and one of said plurality of axial sections being tapered with a first constant gradient, another of said sections being tapered with a second constant gradient different from said first constant gradient, the taper gradient in the axial direction is different in plural portions in the circumferential direction of the inner wall, wherein an inner wall section of at least one end of the waveguide has an elliptical shape.

* * * * *